US007017191B2

(12) United States Patent
Golde

(10) Patent No.: US 7,017,191 B2
(45) Date of Patent: Mar. 28, 2006

(54) VENTILATED PROTECTIVE GARMENT

(76) Inventor: Paul Golde, 15602 Mosher Ave., Tustin, CA (US) 92780

( * ) Notice: Subject to any disclaimer, the term of this patent is extended or adjusted under 35 U.S.C. 154(b) by 526 days.

(21) Appl. No.: 10/059,999

(22) Filed: Jan. 29, 2002

(65) Prior Publication Data

US 2003/0140404 A1 Jul. 31, 2003

(51) Int. Cl.
*A41D 27/16* (2006.01)
*A41D 1/00* (2006.01)

(52) U.S. Cl. ..... 2/93; 2/59; 2/60; 2/69.5; 2/123; 2/268; 2/917; 2/DIG. 1

(58) Field of Classification Search ..... 2/59, 2/60, 69.5, 93, 123, 124, 268, 917, DIG. 1
See application file for complete search history.

(56) References Cited

U.S. PATENT DOCUMENTS 2,151,211 A * 3/1939 Babiner ..... 192/13 A
2,715,226 A * 8/1955 Weiner ..... 2/79
3,761,962 A * 10/1973 Myers ..... 2/79
4,242,769 A * 1/1981 Rayfield et al. ..... 441/91
4,608,715 A * 9/1986 Miller et al. ..... 2/1
5,105,477 A * 4/1992 Golde ..... 2/93
5,704,064 A * 1/1998 van der Sleesen ..... 2/69
6,085,353 A * 7/2000 van der Sleesen ..... 2/69
6,263,510 B1 * 7/2001 Bay et al. ..... 2/93
6,427,242 B1 * 8/2002 Bush et al. ..... 2/69

* cited by examiner

*Primary Examiner*—Danny Worrell
*Assistant Examiner*—Robert Muromoto
(74) *Attorney, Agent, or Firm*—Terry L. Miller

(57) ABSTRACT

A ventilated protective garment particularly for wear by operators, occupants, and passengers of sports motor vehicles, such as motorcycles for example, includes a garment body which may be configured as a jacket or coat, and which includes an especially configured vent structure at sleeves of the garment, which vent structure provides for selective opening of a vent passage on the sleeve forearm portion, while also insuring against the sleeves sliding up the wearer's arms in the event of a fall from the moving vehicle followed by a tumble and slide on gravel or pavement, for example. Thus, the wearer of the garment may select to be provided with desirable ventilation, or to close the forearm ventilation openings, and is protected against forearm abrasion regardless of whether the forearm vent openings are opened or closed.

4 Claims, 6 Drawing Sheets

VENTILATED PROTECTIVE GARMENT

BACKGROUND OF THE INVENTION

1. Field of the Invention

The present invention relates to an aerodynamic ventilated protective garment which may take the form of a jacket or coat. The garment is especially configured and structured for wear by individuals who are riding on or operating open-air sport motor vehicles, such as motorcycles, dune buggies, ATV'S, ATC's, and perhaps even open-air aircraft, such as ultra-light aircraft. These operators and passengers are subjected to the elements, need physical protection for their person, desire to not be buffeted or to have their garments "balloon" or to flap in the high speed air flow caused by movement of their vehicle, and also desire an adequate ventilation air flow during warm-weather and hot-weather conditions. Also, these operators and passengers of open-air sport motor vehicles generally desire to obtain the best possible performance from their sport vehicles, and reducing aerodynamic drag is an important consideration in realizing this desire. Further, such operators and passengers in many cases will be wearing a protective crash helmet, and the airflow caused by the movement of the vehicle will flow about this helmet. In many cases, the airflow about a passenger's or operator's helmet and outer garment causes turbulence, which undesirably buffets the person and increases aerodynamic drag.

2. Related Technology

Operators of motorcycles and other sports motor vehicles have long sought to protect themselves from injury in the event of a mishap, such as a fall from a moving motorcycle and subsequent slide on gravel or pavement. Thus, it is seen that protection from impact and abrasion are both important to operators of such sport motor vehicles. Competition motorcycle riders have commonly worn full "leathers", which are a full cover-all type of leather suit, many having built in panels of cushioning or protective body armor, or abrasion resistant panels. Such a full leather suit can provide good protection from both impact and abrasion.

However, in cool weather, a leather motorcycle riding suit can be chilly to wear. Leather by itself does not provide very good insulation. On the other hand, in warm weather, the full leather motorcycle riding suit can be very warm to wear as leather does not allow much ventilation by itself. Consequently, for warm-weather wear, such "leathers" made to include perforated leather panels have been available. But, leathers made to include perforated leather are not at all suitable for wear during cold riding conditions. Consequently, these "racing style leathers", are generally made for the particular conditions under which they are to be used, and are not practical for wear by the street motorcycle rider and for other operators and passengers on open-air sport motor vehicles who encounter widely varying environmental conditions.

Further, operators of high performance competition motorcycles have long used aerodynamic aids on their motorcycles and on their racing apparel to reduce buffeting and to improve air flow over the rider's helmet and leathers. These aerodynamic aids have included such things as various configurations of fairings on the motorcycles (even extending to the full "dust bin" type of motorcycle fairings), fins, scoops, and winglets on the motorcycle fairings, and also fins and air scoops on the rider's helmet.

In particular, one aerodynamic expedient or aid that has been used on the apparel of competition motorcycle riders is an aerodynamic "hump structure" disposed on the back of the rider's leathers and immediately behind the rider's helmet when the rider is in the position occupied when at speed on the motorcycle. This aerodynamic "hump structure" helps reduce aerodynamic drag, and reduces buffeting of the rider by smoothing airflow over the helmet, and by smoothing airflow rearwardly from the helmet along the back of the leathers at speed. Such an aerodynamic "hump structure" has not heretofore been used on apparel for street motorcycle riders.

Particularly, the competition type of aerodynamic hump structure, while advantageous aerodynamically, is very hot for the rider in warm weather. That is, there is no ventilation provided, and the smooth airflow over the rider's helmet and leathers may actually make it more difficult for the rider to achieve adequate ventilation, and to remain cool, dry, and mentally fresh during warm riding conditions. Consequently, competition riders have complained of being sweaty, over heated, and fatigued because of such lack of ventilation of their racing apparel. But, competition riders still continue to use this apparel because of its advantages in competition.

For the street motorcycle rider, such considerations would rule out the use of the aerodynamic hump structure on the rider's apparel. Nevertheless, street motorcycle riders have favored various leather jackets and coats because of the abrasion resistance provided by the leather in the event of a spill from the moving motorcycle. Many of these jackets traditionally do not have any form of body armor for the rider. Some have no particular provision for ventilation to the rider in warm and hot weather. Particularly in hot weather, leather apparel can be uncomfortably warm to wear. However, even in hot weather some motorcycle riders endure the discomfort of a leather jacket, not because it is needed for protection from the elements, but because of concerns for personal safety and survival in the event of a spill from the street motorcycle at any speed.

On the other hand, in hot weather some cavalier motorcycle riders partially or fully open the front zipper or snaps of their jacket in order to allow the moving air stream to rush in. Such an expedients decreases the effective protection level afforded by the leather jacket of coat. That is, this expedient is very unsafe because it allows the jacket to billow or whip in the air stream, possibly compromising the rider's ability to control the vehicle, and certainly contributing to rider fatigue after a period of being subjected the whipping leather jacket. Fatigue and the resulting decrease in the rider's situational awareness may be a contributing factor in many motorcycle accidents. Importantly, in the event of a spill, an open jacket or coat is more likely to slide up the wearer's torso, and provide little or no protection against abrasion. And, an open front zipper can allow stones to enter the jacket during a fall and slide.

Some motorcycle jackets even include cuff openings on the sleeves, and some riders leave these openings unsecured during warm weather in order to obtain some ventilation. Open cuffs are also very dangerous because the sleeves of the jacket of coat may slide up the forearms during a fall and slide, allowing the forearms to be badly abraded by the gravel or pavement along which the individual may be sliding after a fall from the moving vehicle.

So to, street motorcycle riders generally wish to enjoy the maximum possible performance from their motorcycle, while still being able to ride in a widely varying environment encountered by the street rider, and not having to purchase a wide variety of different garments for wear under varying conditions. Thus, the designer of apparel for the street rider is faced with a daunting set of requirements.

Over some time in the past, leather and fabric jackets and coats with provisions for ventilation while closed and still providing adequate protection to the wearer have been developed. Examples of leather coats and jackets which are conventional are seen in U.S. Pat. No. 4,608,715, issued Sep. 2, 1986 to Richard Miller and John Wyckoff; in U.S. Pat. No. 5,105,715, issued Apr. 21, 1992 to Paul Golde, and in U.S. Pat. No. 5,507,042, issued Apr. 16, 1996 to Michael van der Slessen. German patent publication No. DE 3818-566-A1 published Dec. 7, 1989, provides another example of this conventional approach to providing protection and ventilation to riders of motorcycles. U.S. Pat. No. 5,845,336 provides an example of a fabric jacket or coat that well suits the wide range of requirements for a street motorcycle rider.

SUMMARY OF THE INVENTION

In view of the deficiencies of the related technology, a primary object of this invention is to avoid one or more of these deficiencies.

More particularly, it is an object of this invention to provide a protective garment for wear by operators and occupants of sport vehicle, which will provide physical protection to the wearer, provides adequate and adjustable ventilation for fair and hot days.

Still another object for this invention is to provide a garment for motorcycle riding in which sleeves of the garment are provided with a circumferentially continuous cuff, so that the sleeves cannot slide up the wearer's arms during a fall and slide, but which sleeves also provide for the introduction of cooling ventilating air into the garment at the sleeves.

Accordingly, the present invention according to one aspect provides a ventilated garment, the garment comprising: a garment shell having a front panel and a back panel cooperatively providing a neck opening, and a pair of sleeves, one sleeve for each of the wearer's arms, a generally vertically extending opening dividing the front panel into two parts and allowing ingress and egress from the garment; the pair of sleeves each having a forearm portion extending between an elbow portion of the respective sleeve and a respective cuff structure at a terminal end of each sleeve; at least one of the pair of sleeves defining a ventilation structure in the forearm portion thereof, which ventilation structure includes an elongate ventilation slit extending lengthwise of the forearm portion, a flexible air-permeable panel spanning the slit and limiting the extent to which the slit may gap open, and a fastener structure moving between a first position and a second position to respectively close and open the ventilation slit.

Accordingly, the present invention according to another aspect provides a ventilated and protective garment, the garment comprising: a garment shell having a front panel and a back panel cooperatively providing a neck opening, and a pair of sleeves, one sleeve for each of the wearer's arms, a generally vertically extending opening dividing the front panel into two parts and allowing ingress and egress from the garment; the pair of sleeves each having a forearm portion extending between an elbow portion of the respective sleeve and a respective cuff structure at a terminal end of each sleeve; each of the pair of sleeves defining a respective ventilation structure in the forearm portion thereof; the ventilation structure including an elongate ventilation slit extending lengthwise of the forearm portion across the cuff structure and to the termination end of the sleeve; the ventilation structure further including a flexible air-permeable panel spanning the ventilation slit and limiting the extent to which the slit may gap open; a fastener structure for selectively opening and closing the ventilation slit, the fastening structure including a closure member moving between a first position and a second position to respectively close and open the ventilation slit; the fastener structure including a slide fastener having a pair of elongate track portions each secured to a respective side of the ventilation slit and a slide member moving along the slide fastener between the first position in which the elongate track portions are joined along their length to close the ventilation slit, and a second position in which the elongate track portions are at least partially disconnected from one another to thereby at least partially open the ventilation slit and outwardly expose the air-permeable panel.

A better understanding of the present invention will be obtained from reading the following description of a several preferred exemplary embodiments of the present invention when taken in conjunction with the appended drawing Figures, in which the same features (or features analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a perspective frontal view of a motorcycle rider wearing a garment in the form of a coat embodying the present invention;

FIG. 2 is a fragmentary side elevation view of the rider seen in FIG. 1;

FIG. 2*a* is a fragmentary side elevation view partially in cross section of a portion of the garment seen on the rider in FIGS. 1 and 2;

FIGS. 3 and 4 respectively provide rear and front elevation views of the garment seen in the preceding Figures;

FIG. 5 provides a fragmentary elevation view of an alternative embodiment of a garment embodying the present invention;

FIG. 6 is a fragmentary cross sectional view taken at line 6—6 of FIG. 5;

FIG. 7 provides a fragmentary side elevational view similar to that of FIG. 2*a*, but illustrating the alternative embodiment of the invention of FIGS. 5 and 6;

DETAILED DESCRIPTION OF EXEMPLARY PREFERRED EMBODIMENTS OF THE INVENTION

Figure 1:
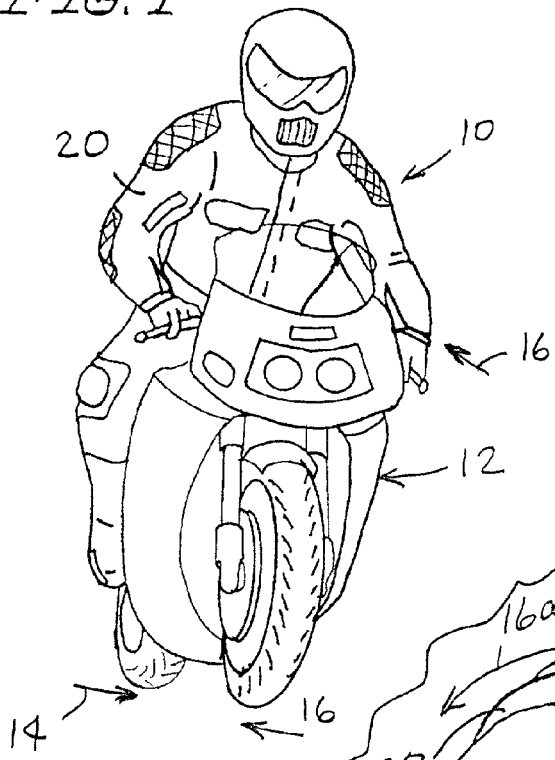
Figure 2:
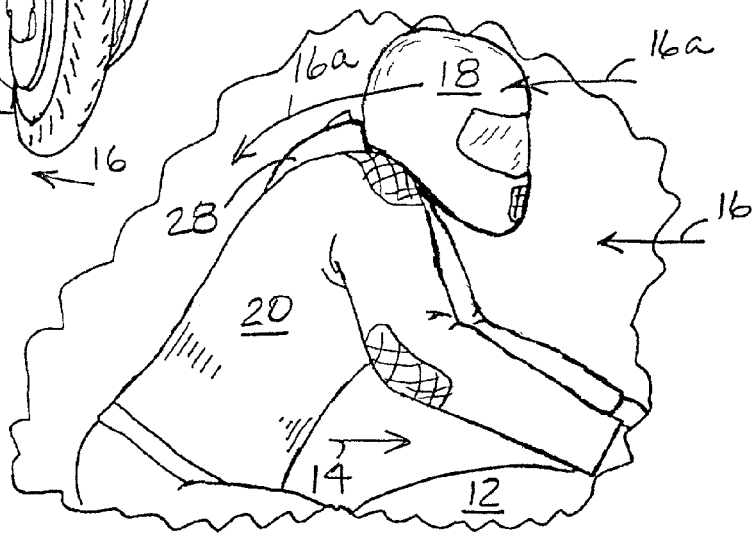

Viewing first FIGS. 1 and 2 in conjunction, a motorcycle rider 10 is seen riding a motorcycle 12. Because of the speed of forward movement (indicated by arrow 14) of the motorcycle, the rider 10 is subjected to a moving air stream relatively moving in the rearward direction (as is indicated on FIGS. 1 and 2 by arrow 16). The rider 10 is wearing a helmet 18, and in addition to boots and gloves (not referenced on the drawing Figures) is also wearing a protective garment 20, which in this case takes the form of a coat or long jacket. It will be understood that the invention is not limited to its use by motorcycle riders, and that other operators and occupants of sports motor vehicles may benefit from the use of this invention. Further, the invention is not limited to embodiment in a jacket or coat, and may find embodiment in a full cover-all type of riding suit, for example.

In the particular case illustrated in FIG. 1, the rider 10 is also wearing protective gloves, boots, and a helmet 18 (not all of which are individually referenced in FIG. 1), and this protective apparel is important to the rider in the event of an unplanned fall from the moving motorcycle. The rider 10 may be wearing a pair of heavy denim jeans, leather pants, or other protective pants, as well. While this protective apparel is important to the rider 10 in the event of a fall from the motorcycle, it can also undesirably contribute to overheating of the rider during warm weather riding conditions, or even during moderate weather conditions. Thus, ventilation to of the apparel of the rider 10 is an important consideration in providing comfort to the rider and in keeping the rider mentally fresh and well able to operate the vehicle 10.

As is seen in FIG. 1, and as is further illustrated and explained below by reference to FIG. 4, the garment (i.e., jacket) 20 includes a front panel 20*f*, which is in two parts, with the parts cooperatively defining a central generally vertical opening 20*o*. The central opening 20*o* is conventionally secured closed by the use of a zipper, and possibly by plural snaps as well (not referenced in the drawing Figures), thus allowing this opening to be opened to allow the jacket 20 to be put on and taken off. The garment 20 also includes a rear panel 20*r*, and is provided with sleeves 22*r* and 22*l* (for "right" and "left") each having a cuff 24 with a cuff closure structure 24*a*, and an associated forearm sleeve ventilation structure 26. It is to be noted that the cuff closure structure 24*a* is similar to the opening 20*o* in that it can be opened to allow the jacket to be put on and taken off. Thus, the closure structure 24*a* may include, for example, a strap secured by snap, or secured by matching patches of hook-and-loop fastener material, as will be further explained.

Figure 4:
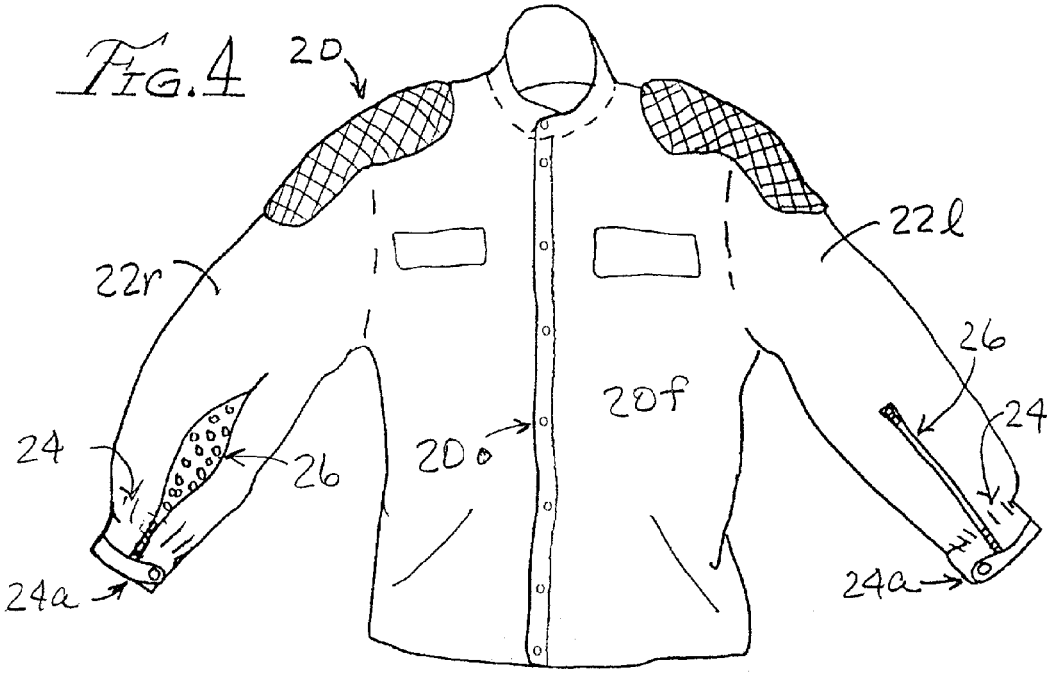

In FIG. 1, and on the right sleeve 22*r* of FIG. 4, the sleeve ventilation structure 24*a* is opened, so that an underlying perforate (i.e., air permeable) panel 24*b* is exposed, and it will be understood that the air stream 16 drives ventilation air flow into the sleeve 22 of the jacket 20 via this open sleeve ventilation structure. That is, the forearm sleeve ventilation structure 26 is disposed on the inner forwardly exposed portion of the forearms of rider 10. On the left sleeve 22*l* of jacket 20 it is seen that the sleeve ventilation structure 26 is closed, as will be further explained. As is shown on both sleeves, the cuff closure structure 24*a* is closed, and the cuff 24 is thus secure against sliding up the rider's forearm in a slide along the ground. On the other hand, it is important to note the significance of the forearm location of the ventilation structure 26. Because of the forward location of the ventilation structure 26 along the forearms of the rider 10, that ventilating air that enters the structure 26 flows upwardly and rearwardly along the greater portion of the rider's arms, and provides significant cooling to the rider's arms. Further, this air then flows into the main body of the jacket 20, further contributing to cooling of the rider 10.

Figure 3:
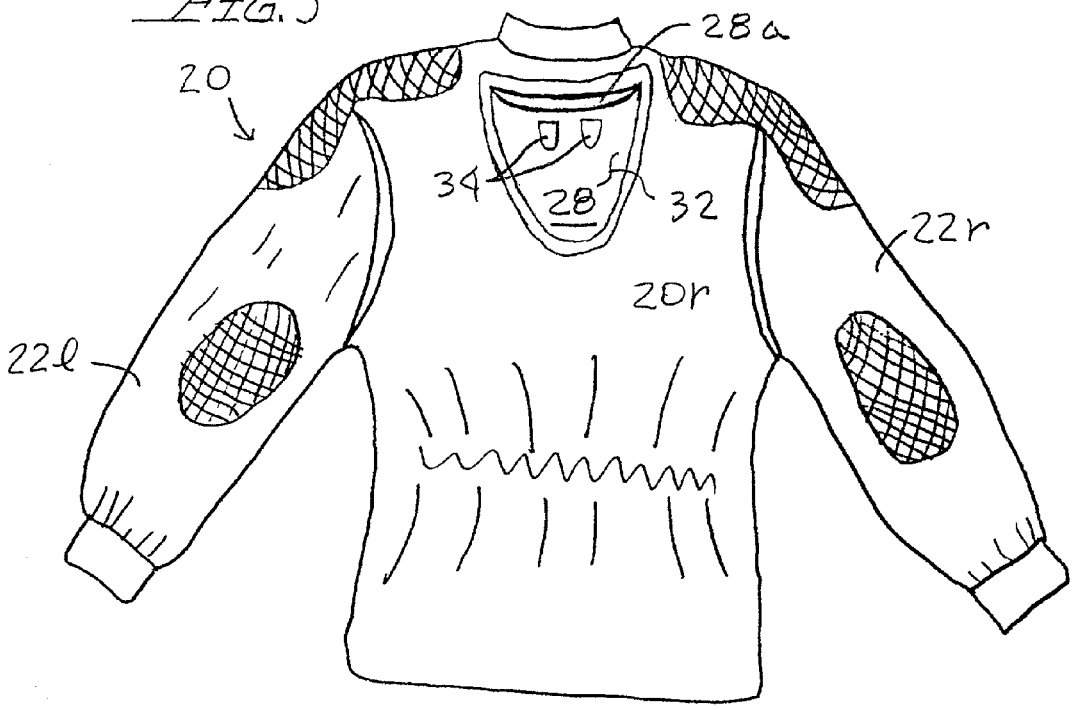

Further to the above, FIGS. 2 and 3 illustrate that the jacket 20 includes a ventilated aerodynamic hump structure 28 on the rear of the jacket 10 immediately behind the rider's helmet 18 in the position the rider occupies on the motorcycle 12 at speed. That is, viewing FIG. 2, (and is illustrated by the stream line arrows 16*a*) at speed, the air stream 16 flows around the rider's helmet 18 and flows rearwardly along the back of the jacket 20. The aerodynamic hump structure 28 smoothes air flow over the helmet 18 and smoothes the airflow transition from flow about the helmet 18 and onto the back of the jacket 20. This ventilated hump structure 28 defines a forwardly disposed arcuate recess 28*a*, disposed toward the rear of the rider's helmet 18, and in the position seen in FIG. 2, spaced only slightly away from the helmet 18.

Further, as can best be appreciated viewing FIG. 2, in the event of a fall of the rider 10 from the motorcycle 12, the presence of the hump structure 28 immediately behind the rider's helmet 18 can assist in preventing hyper-reflexion of the rider's neck. That is, the helmet 18 will contact the front of the hump structure 28 at the recess 28*a*, and be supported so that the rider's neck is supported in opposition to being subjected to hyper-reflexion.

Figure 2A:
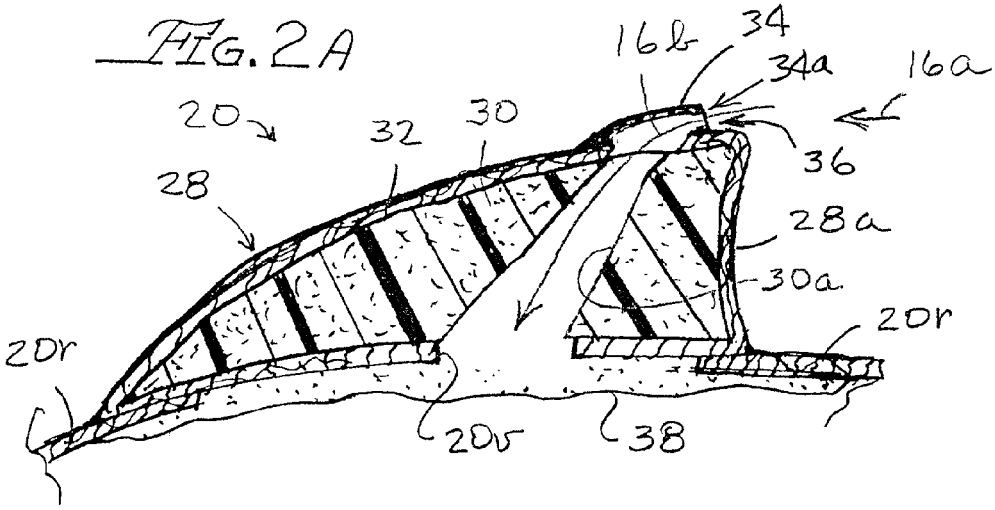

FIG. 2*a* illustrates that the hump structure 28 is formed principally by a flexible but rather stiff and shape-retaining foam core 30, which is secured to the back panel 20*r* of the jacket 20. This foam core is covered with a similarly shaped portion of material 32, which material may be the same as or different from the material of the back panel 20*r* of the jacket 20. The material 32 is preferably secured to the back panel of the jacket 20 by stitching, not seen in the drawing Figures, and thus holds the core 30 in place as well. In order to provide for ventilation through the hump structure 28, this structure carries at least one forwardly opening scoop 34. The scoop 34 defines an opening 34*a*, which may be spanned by a fine screen 36 in order to prevent insects and small gravel from entering the scoop. The scoop 34 receives a portion of the air flow 16, as is indicated by arrow 16*b*. This scoop 34 also defines a passage 34*b* leading from the opening 34*a* toward the foam core 30. Aligning with the passage 34*b* of the scoop 34, the foam core 30 defines a through passage 30*a*, which is preferably divergent to provide diffusion of the air flow 16*b* to a lower speed and higher pressure as it moves along this passage. The passage 30*a* leads to a ventilation opening 20*v* defined by the rear panel 20*r* of the jacket 20. This opening 20*v* leads through the rear panel 20*r*, and into the space between the rear panel 20*r* and an air permeable liner 38 of the jacket 20. Thus, when the motorcycle is moving at speed and the rider 10 is in a position allowing the scoop 34 exposure to the air flow 16, a portion of this air flow is brought into the jacket 20 via the hump structure 28 and via the scoop 34, passage 34*b*, passage 30*a*, and ventilation opening 20*v*.

Returning now to a consideration of FIGS. 1, and 9–11, it is seen that the sleeve ventilation structure 26 in this embodiment is formed by a single lengthwise extending slit 26*a*, running from the cuff 24 partially upwardly along the forearm portion of each sleeve 22*r* and 22*l* (only one sleeve 22*l* being illustrated in FIGS. 9–11, the other sleeve 22*r* being a mirror image), along the forward and inner aspect of these sleeves. The slits 26*a* are each selectably closed by a combination of the respective cuff closure 24*a* and a slide fastener (i.e., a zipper in this embodiment, although the invention is not so limited) 40 having a pair of oppositely disposed and acting zipper pulls (or slide members) 40*a* and 40*b*. The cuff closure 24*a* includes a strap or tab 42 spanning across this slit 26*a* at the cuff 24. The strap or tab 42 is secured to the opposite side of the cuff (i.e., on the opposite side of the slit 26*a*) by a securing member 44, such as by a snap or by a patch of hook-and-loop fastener, for example.

Figure 9:
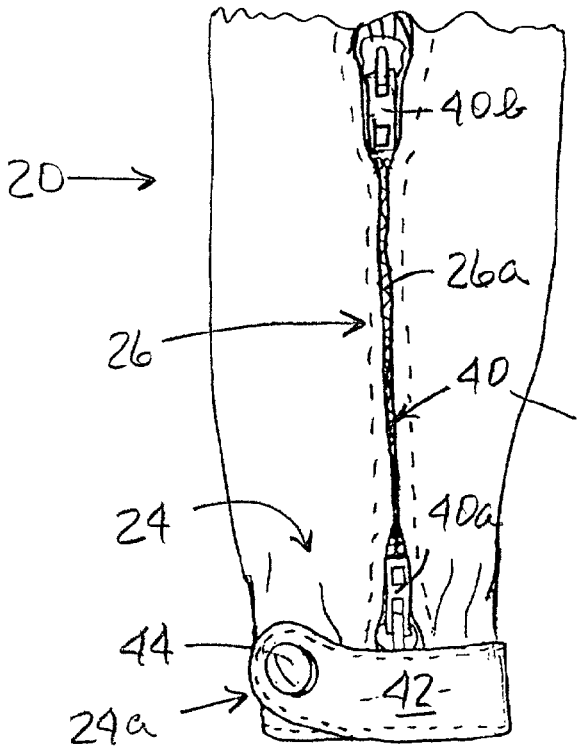
FIGS. 9–11 are fragmentary views of the embodiment of the invention shown in FIGS. 1–3, and 4, with a venting cuff structure respectively shown in closed, opened, and ventilating configurations.

On the left sleeve 22*l* as seen in FIGS. 4 and 9, both the cuff closure 24*a* and the zipper 40 are closed (by having the zipper pulls 40*a* and 40*b* both at opposite ends of this zipper, so that ventilating air cannot enter the sleeve vent structure 26. On the other hand, on the right sleeve 22*r* seen in FIGS. 4 and 11, the cuff closure 24*a* is closed, but the sleeve vent structure 26 is partially opened by having the upper zipper pull 40*b* slid partially downwardly along the zipper 40 toward the lower pull 40*a*. This position of the zipper pull 40*b* results in the upper portion of slit 26*a* being allowed to gap open. This gapping open of the upper portion of the slit 26*a* is controlled however, and is limited in extent by a combination of structures. On the one hand, the lower extent of the slit 26*a* is closed at the cuff 24 by cuff closure 24*a*. The lower portion of the slit 26*a* is still closed by the lower portion of zipper 40, dependent upon the position of lower zipper pull 40*a*. And, the extent of opening or gapping open of the slit 26*a* is determined by a v-shaped, perforate, air permeable panel 46 spanning across the slit 26 and secured to the material of the sleeve 22 on each side of this slit. The panel 46 may be made of perforate leather, or may be made of a woven or knitted material having a sufficiently open mesh as to allow air to permeate therethrough. Alternatively, the panel 46 may utilize a fabric panel that is knitted or woven so at to provide plural evenly spaced openings in the form of a mesh. The v-shape of the panel 46 is secured to the respective sleeve 22 with a narrow end of the v-shape adjacent to the upper extent of the slit 26*a*, and with a wider portion of the panel adjacent to the cuff 24, so that this cuff can open to allow the jacket 20 to be put on and taken off, as is to be further described.

It will thus be understood that the forearm sleeve ventilation structure 26 can also be opened by partially or full sliding the lower zipper pull 40*a* upwardly along the sleeve 22 toward the upper pull 40*b*. This results in an opening being created along slit 26*a* from the lower end thereof. Thus, it will be understood that dependent on the wishes of the rider 10, the zipper pulls 40*a* and 40*b* can be slid partially or full toward one another along the slit 26*a* to open a lower extent, an upper extent, or both a lower extent and an upper extent of the slit 26*a*, with the zipper pulls either spaced slightly apart or being fully together somewhere intermediate of the ends of the slit 26*a*. In this way, the rider 10 has a great deal of flexibility and adjustability in the area and location of ventilation opening or openings created at the slit 26*a* on each sleeve of the jacket dependent upon the selected locations chosen for the zipper pulls 40*a* and 40*b*.

Figure 10:
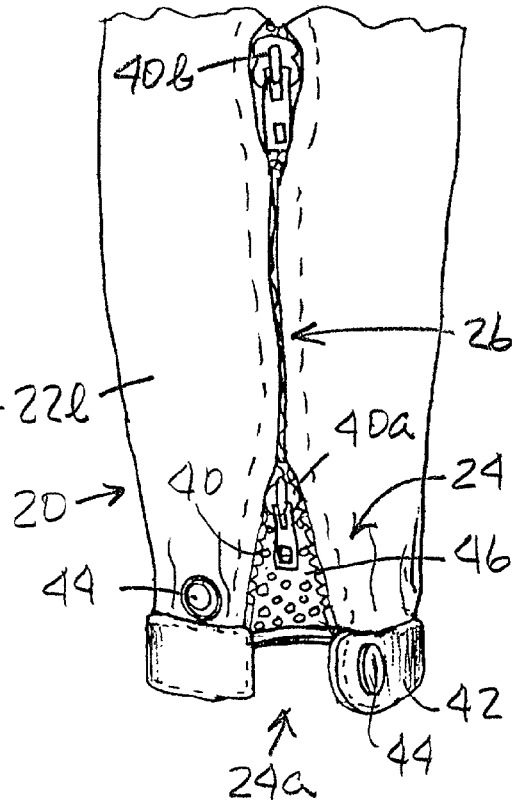
Figure 11:
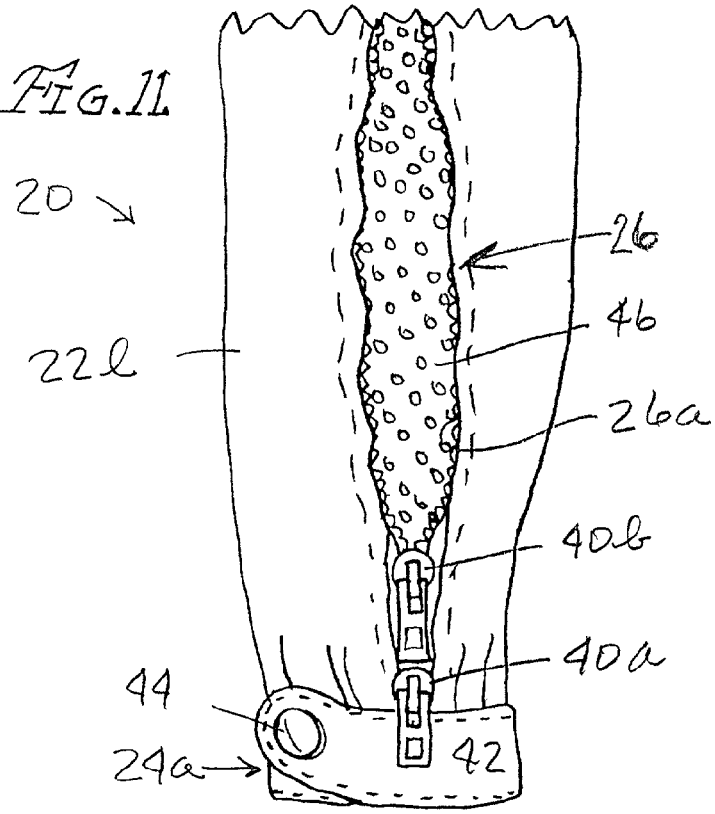

FIG. 10 illustrates that the upper zipper pull can be moved to the upper extent of the zipper 40 (closing the zipper), while the lower zipper pull 40*a* is also moved partially or fully up the zipper 40 (opening the zipper), at the same time that the cuff closure 24*a* is opened (i.e., by releasing the securing member 44). Thus, the cuff 24 is opened enough to allow the rider 10 to easily put on or take off the jacket 20. It is to be noted however, that so long as the cuff 24 is closed by closure structure 24*a*, and even with the vent structure 26 open, the rider 10 is protected against having the sleeves 22 slide up along the rider's forearms in the event of a fall and slide. This is the case because the cuffs 24 remain secured about the riders' wrists regardless of whether the vent structure 26 is opened or closed. Further, in the event that the vent structure 26 is open during a fall and slide, the perforate panel 46 both limits the extent to which the slit 26*a* may gap open, and prevents gravel from entering the slit. Understandably, the rider would not want gravel inside of the jacket with him during such a slide after a fall from the motorcycle.

Turning now to FIGS. 5–8, these Figures fragmentarily illustrate an alternative embodiment of the jacket 20 that is the same as that illustrated and described above with the exception of the distinctions and differences illustrated and described below. Because of the similarities between the embodiment of FIGS. 1, and 9–11, and that of FIGS. 5–8, features which are the same or which are analogous in structure or function to those described above are referenced using the same numeral used above, and having one-hundred (100) added.

Figure 5:
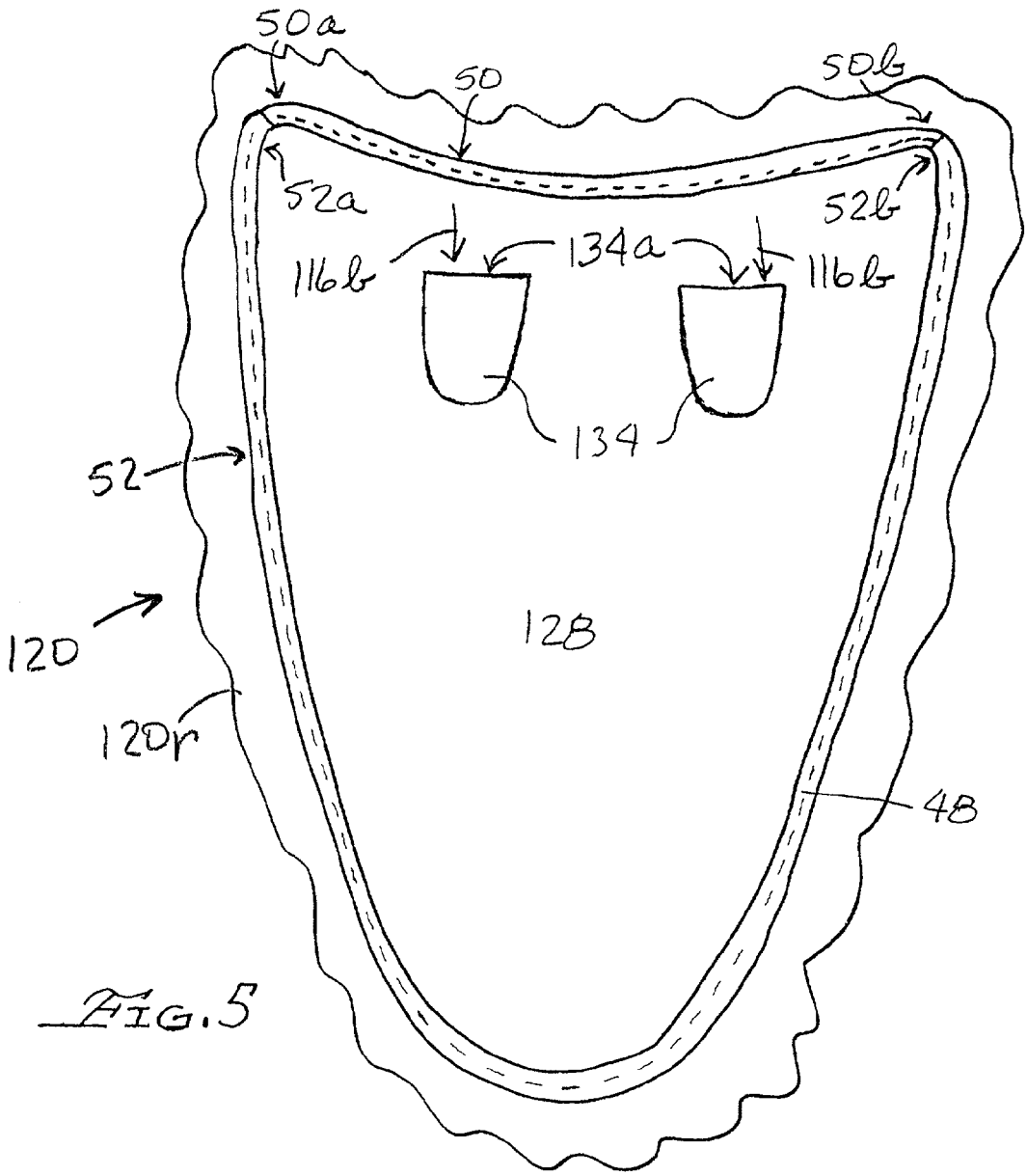
Figure 6:
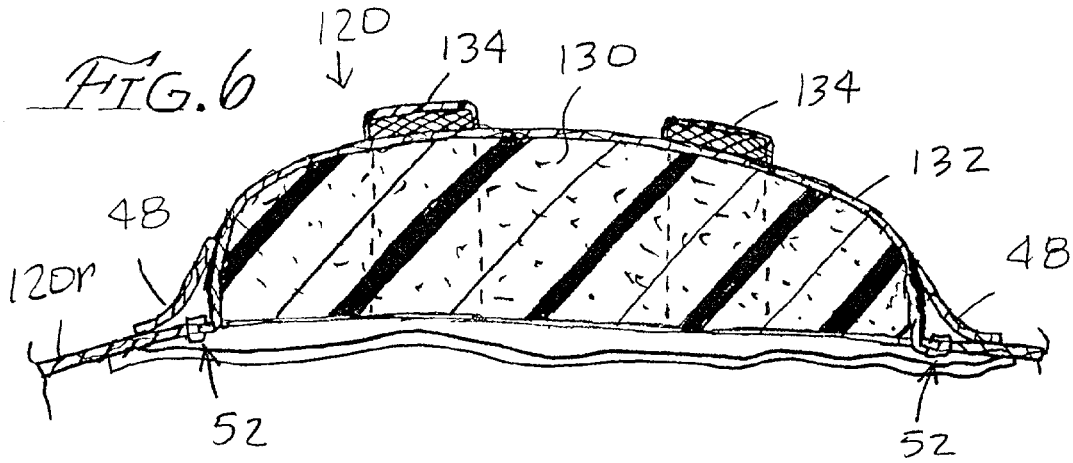
Figure 7:
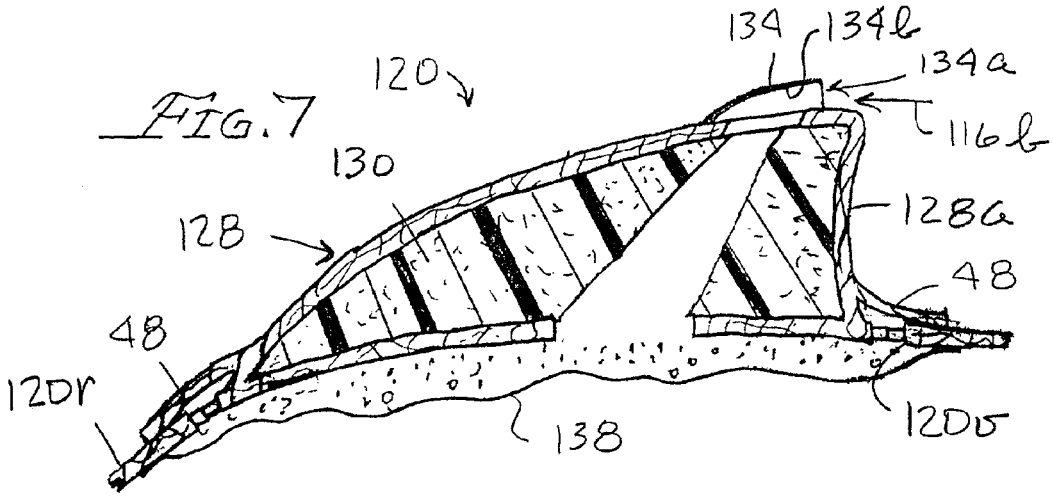

Viewing now FIGS. 5–8, and particularly FIG. 5, it is seen that the back panel 120*r* of a jacket 120 is illustrated. This back panel 120*r* carries an aerodynamic hump structure 128. Again, this hump structure 128 is formed principally by a flexible but rather stiff and shape-retaining foam core 130, which is in this case is removably secured to the back panel 120*r* of the jacket 120. The foam 130 core is covered with a similarly shaped portion of material 132, which material may be the same as or different from the material of the back panel 120*r* of the jacket 120. In this case, the material 132 is not stitched to the back panel of the jacket 120, but includes an outwardly extending peripheral flange or flap 48. This flap 48 extends in this embodiment entirely about the periphery of and is part of the aerodynamic hump structure 128. As is best seen in FIGS. 5 and 6, the hump structure 128 is secured to the back panel 120*r* of the jacket 120 by a pair of zippers 50 and 52 cooperatively circumscribing the foam core 130. That is, a first zipper 50 extends arcuately across a front aspect of the core 130 from a first end indicated by the arrow 50*a* to a second end indicated by arrow 50*b*. This zipper has elongate track or teeth portions that are joined when the zipper pull is at the location indicated by arrow 50*a*, and which are separable from one another when the zipper pull is moved to the position indicated by arrow 50*b*. Similarly, a second zipper 52 extends arcuately from a first end indicated by the arrow 52*a* to a second end indicated by arrow 52*b*. Again, and similarly, the second zipper 52 has elongate track or teeth portions that are joined when the zipper pull is at the location indicated by arrow 52*a*, and which are separable from one another when the zipper pull is moved to the position indicated by arrow 52*b*. As will be understood, one of the elongate zipper track portions or teeth portions of each zipper 50 and 52 is secured to the aerodynamic hump structure 128, while the mating portion of the zipper is secured to the back panel 20*r* of the jacket 20.

Again, in order to provide for ventilation through the aerodynamic hump structure 128, this structure carries at least one forwardly opening scoop 134. The scoop 134 defines an opening 134*a* receiving a portion of the air flow 116, as is indicated by arrow 116*b*. This scoop 134 also defines a passage 134*b* leading from the opening 134*a* toward a through passage 130*a* defined by the foam core 130. The passage 130*a* leads to a ventilation opening 120*v* defined by the rear panel 120*r* of the jacket 120. In this embodiment, the ventilation opening 120*v* may be quite large, so that ventilating air is presented to the liner 138 of the jacket over a considerable area. This wide area coverage of the ventilating air favorably contributes to keeping the rider cool without creating an uncomfortable "cold" spot.

Figure 8:
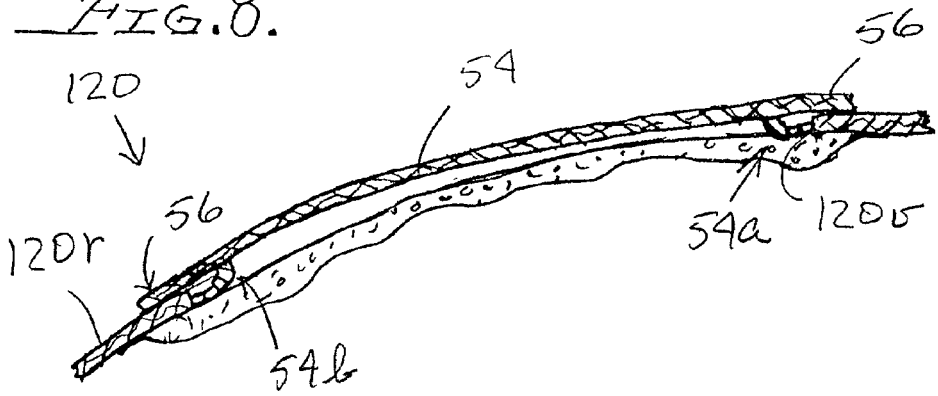
FIG. 8 is a fragmentary side elevation view similar to that of FIG. 7, but showing a closure member fitted to the garment.

However, as will be appreciated in view of the explanation above, the aerodynamic hump structure 128 is removable from the rear panel 120*r* of the jacket 20 by moving the zipper pulls of zippers 50 and 52 to the locations indicated by arrows 50*b* and 52*b*, and then disengaging the zipper tracks or zipper teeth portions from one another. This results in the aerodynamic hump structure 128 being removed from the jacket 120. The hump structure 128 is, of course, capable of being reinstalled on the jacket 120 by actions in the reverse of the removal actions just explained. However, it is also clear that once the hump structure 128 is removed from the jacket 120, this jacket is left with a rather large opening 120*v* through the rear panel 120*r*, and opening to the liner 138 of the jacket. In order to provide a closure for this opening 120*v* when the wearer of the jacket wishes to use the jacket without the aerodynamic hump structure 128, this embodiment provides for a closure member 54 to be zipped onto the jacket in the same way as the hump structure 128 would be. That is, the closure member 54 is shaped like the hump structure 128 in plan view (i.e., in rear elevation view of the jacket), but does not include a hump or ventilation openings. Again, in elevation view, as is seen in FIG. 8, the member 54 is substantially flat. This closure member 54 includes zipper tracks or teeth portions 54*a* and 54*b* just like those on the hump structure, which are engageable with the portion of the zippers 50 and 52 secured to the jacket 120, and are disposed under a covering peripheral flap 56. In this case, the peripheral flap portion 56 is a peripheral portion of the closure member 54 outwardly of the zipper portions 54*a* and 54*b*. When the closure member 54 is secured to the jacket, the opening 120*v* is closed by this closure member, and the zippers 50 and 52 are concealed by the flap 56. Preferably, the closure member is made to include matching surface colors and possibly matching graphics to the back panel 120*r* of the jacket 120. Thus, when the closure member 54 is in place on the jacket 120, the jacket appears much as a conventional jacket would appear from the back.

Figure 12:
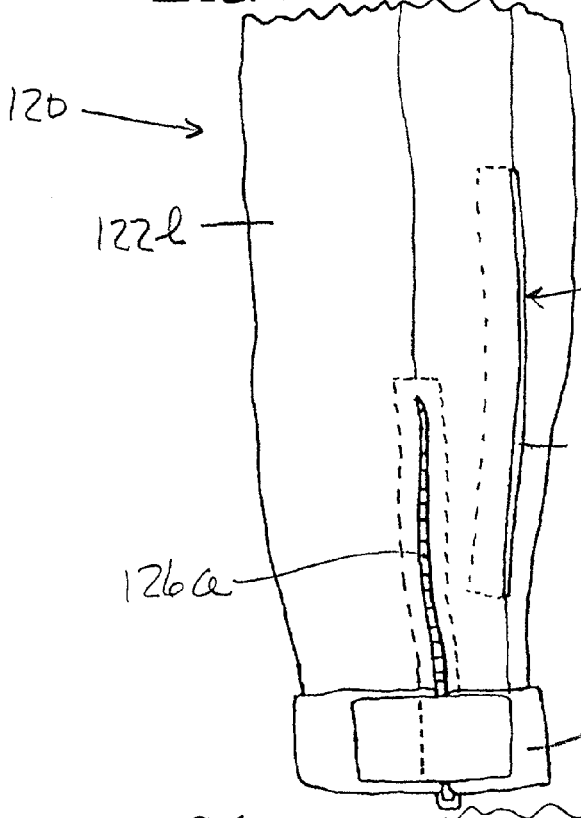
FIGS. 12–14 are fragmentary views of an alternative embodiment of the invention, with a venting cuff structure respectively shown in closed, opened, and ventilating configurations.
Figure 13:
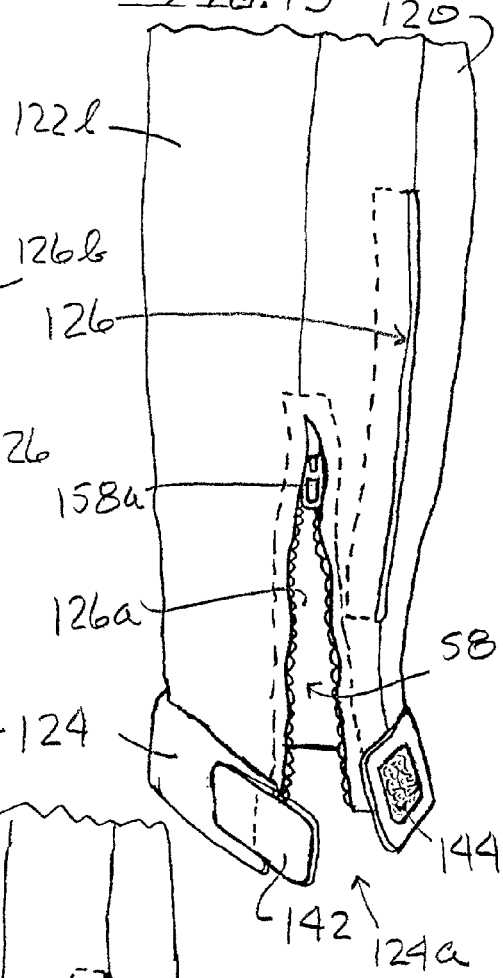
Figure 14:
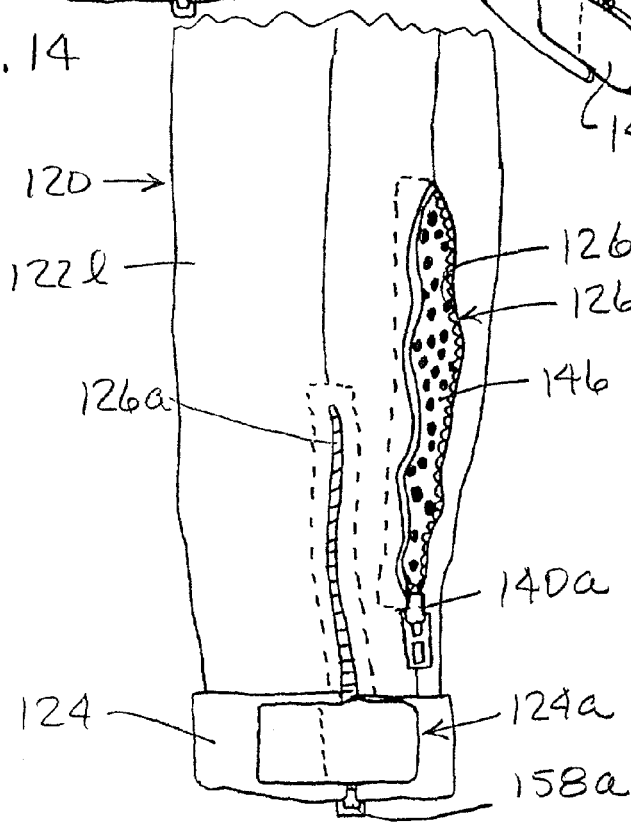

Finally, turning now to FIGS. 12–14, taken in conjunction with one another, yet another alternative embodiment of the present invention is illustrated, and will be described in enabling detail below. This embodiment also shares many features with the embodiment illustrated in FIGS. 1 and 9–11 above, so features which are the same as or which are analogous in structure or function to those illustrated above are referenced on FIGS. 12–14 using the same numeral used above and increased by one-hundred (100). Viewing FIGS. 12–14 it is seen that the sleeve cuff closure 124*a*, and the sleeve ventilation structure 126, are in this embodiment are each formed by a respective and separate one of a pair of lengthwise extending slits 126*a* and 126*b*, one (126*a*) running across the cuff 124 and partially upwardly along the forearm portion of each sleeve 122*r* and 122*l* (only the left sleeve 122*l* being seen in FIGS. 12–14), and the other (126*b*) running from the cuff 124 upwardly along the forward and inner aspect of the sleeve. It is seen that the slit 126*b* does not open through the cuff 124. That is, the slit 126*b* is dead ended, and ends at one end at about the cuff 124, and ends at its other end intermediate of the length of the respective sleeve 122. The slits 126*a* and 126*b* are spaced circumferentially apart from one another.

The slits 126*a* and 126*b* are each selectably opened and closed according to the wished of the rider 110. That is, the slit 126*a* is closed by a respective cuff closure 124*a* including a strap or tab 142 and a fastening member 144, along with a slide fastener 58 (i.e., a zipper in this embodiment, although the invention is not so limited). This zipper 58 has only a single zipper pull (or slide member) 58*a*, which closes the slit 126*a* when it is adjacent to the cuff, and which opens this slit as it is moved fully upwardly along the slit 126*a* away from the cuff. As is seen in FIG. 13, when the cuff closure 124*a* is opened then the slit 126*a* is open along its length to allow the rider 110 to easily put on or take off the jacket 120.

At the other slit 126*b*, the sleeve vent structure 126 is opened or closed dependent upon the wishes of the rider 110. That is, the sleeve vent structure 126 is partially or fully opened by having the zipper pull 140*a* slid partially or fully along the zipper 140 toward the opposite end of the zipper 140, The zipper 140 may have the zipper pull 140 disposed either in the upper position when this zipper is closed, or the zipper pull 140 may be disposed at the lower end of this zipper when the zipper is closed. In either case, the rider 110 can partially or fully open the forearm sleeve ventilation structure 126 by moving the zipper pull 140*a* partially or fully to the opposite end of its travel. As is seen in FIG. 14, when the rider 110 opens the sleeve ventilation structure 126, the gapping open of the slit 126*b* is controlled by a perforate panel 146 spanning across this slit and secured to the material of the sleeve 122 at opposite sides of this slit. In this case, the perforate panel 146 is preferably canoe-shaped (i.e., with convergent or pointed ends) to allow the slit to open but to help carry stresses at the ends of this slit.

In view of the above, it is to be noted that the forearm sleeve ventilation structures disclosed above provide ventilation and air flow along essentially the full length of the arm of the wearer of the jacket. That is, if desired, the wearer can achieve ventilating air flow from just above the cuff of the jacket upwardly along the arm and into the body of the jacket. On the other hand, the wearer can shut off this ventilating air flow when desired by closing the vent structure. Similarly, the ventilated aerodynamic hump structure provides for ventilation of the jacket and both improves air flow along the back of the jacket to reduce buffeting, and also offers improved protection to the wearer in the event of a fall by offering support to the helmet so that the rider's head is less likely to be flexed backwardly to an excessive extent.

While the present invention has been depicted, described, and is defined by reference to a single particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A ventilated protective garment, said garment comprising:

a garment shell having a front panel and a back panel cooperatively providing a neck opening, and a pair of sleeves, one sleeve for each of the wearer's arms;

said pair of sleeves each having a forearm portion extending between an elbow portion of the respective sleeve and a respective cuff structure at a terminal end of each sleeve;

each of said forearm portions defining a ventilation structure, which ventilation structure includes an elongate ventilation slit extending lengthwise of said forearm portion across said respective cuff structure and to said terminal end of said forearm portion, a flexible air-permeable panel spanning said slit and limiting the extent to which said slit may gap open, and a slide fastener including a pair of engageable elongate track portions one attached at each side of said slit and a slide member moving along said pair of elongate track portions between a first position and a second position along said slit to respectively engage and disengage said engageable track portions and simultaneously to close and open said ventilation slit, said cuff structure further including a strap portion adjacent to said terminal end of said forearm portion and movable between an unfastened position in which said slit may gap open to allow passage through said cuff of a wearer's hand, and a fastened position in which said strap portion extends circumferentially of said cuff structure and across said slit so that said cuff structure is circumferentially continuous and the sleeve cannot slide up the wearer's arm above the wearer's wrist and to allow said ventilation slit to be opened and closed above said strap portion by said slide fastener.

2. The garment of claim 1 wherein said slide fastener includes a second slide member in a respective first position thereof spaced away from said cuff structure and adjacent said elbow portion of the respective sleeve and said elongate track portions are at least partially joined along their length extending from said slide member toward said cuff structure to at least partially close said ventilation slit, and in said second position said second slide member is moved away from said elbow portion of the respective sleeve and toward said cuff structure to at least partially disconnect said elongate track portions toward said elbow portion from one another and to thereby at least partially open said ventilation slit and outwardly expose said air-permeable panel.

3. A ventilated and protective garment, said garment comprising:

a garment shell having a front panel and a back panel cooperatively providing a neck opening, and a pair of sleeves, one sleeve for each of the wearer's arms, a generally vertically extending opening dividing said front panel into two parts and allowing ingress and egress from said garment;

said pair of sleeves each having a forearm portion extending between an elbow portion of the respective sleeve and a respective cuff structure at a terminal end of each sleeve;

each of said pair of sleeves defining a respective ventilation structure in said forearm portion thereof;

said ventilation structure including an elongate ventilation slit extending lengthwise of said forearm portion across said cuff structure and to said terminal end of said sleeve;

said ventilation structure further including a flexible air-permeable panel spanning said ventilation slit and limiting the extent to which said slit may gap open;

a fastener structure for selectively opening and closing said ventilation slit, said fastener structure including a closure member moving between a first position and a second position to respectively close and open said ventilation slit;

said fastener structure including a slide fastener having a pair of elongate track portions each secured to a respective side of said ventilation slit and a slide member moving along said slide fastener between said first position in which said elongate track portions are joined along their length to close said ventilation slit, and a second position in which said elongate track portions are at least partially disconnected from one another to thereby at least partially open said ventilation slit and outwardly expose said air-permeable panel;

wherein said slide member in said first position thereof is spaced away from said cuff structure and adjacent said elbow portion of the respective sleeve and said elongate track portions are joined at least partially along their length extending from said slide member toward said cuff structure to at least partially close said ventilation slit, and in said second position said slide member is moved away from said elbow portion of the respective sleeve and toward said cuff structure to at least partially disconnect said elongate track portions toward said elbow portion from one another and to thereby at least partially open said ventilation slit and outwardly expose said air-permeable panel in the extent of said ventilation slit between said elbow portion and said slide member;

wherein said slide fastener further includes a second slide member moving along said elongate track portions, said second slide member in a first position at said cuff structure joining said elongate track portions in the extent of said ventilation slit extending from said second slide member toward said elbow portion to at least partially close said slide fastener, and said second slide member being movable to a second position spaced from said cuff structure toward said elbow portion of said sleeve along said elongate track portions to at least partially disconnect said track portions from one another in the extent of said ventilation slit extending from said second slide member to said termination end of said cuff structure so as to expose said air-permeable panel, said cuff structure further including a strap portion adjacent to said terminal end of said forearm portion and movable between an unfastened position in which said slit may gap open to allow passage through said cuff of a wearer's hand, and a fastened position in which said strap portion extends circumferentially of said cuff structure and across said slit so that said cuff structure is circumferentially continuous and said sleeve cannot slide up the wearer's forearm above the wearer's wrist and to allow said ventilation slit to be opened and closed above said strap portion by said slide fastener.

4. A ventilated garment, said garment comprising:

a garment shell having a front panel and a back panel cooperatively providing a neck opening, a pair of sleeves, one of said pair of sleeves for each of the wearer's arms, and a generally vertically extending opening dividing said front panel into two parts and allowing ingress and egress from said garment;

said pair of sleeves each having a forearm portion extending between an elbow portion of the respective sleeve and a respective cuff structure at a terminal end of each sleeve;

each of said pair of sleeves defining a respective ventilation structure in said forearm portion thereof;

said ventilation structure including an elongate ventilation slit extending lengthwise of said forearm portion across said cuff structure and to said termination end of said sleeve;

said ventilation structure further including a flexible air-permeable panel spanning said ventilation slit and limiting the extent to which said ventilation slit may gap open;

a closure structure selectively movable between a first condition in which said closure structure spans and closes said ventilation slit at said cuff structure, and a second position in which said closure structure is opened and allows said ventilation slit to be opened at said cuff with said ventilation slit at least partially opened from said termination end of said sleeve and toward said elbow portion of said sleeve, whereby a wearer's hand may be moved through said cuff structure when opened with said closure structure in said second condition, and when closed with said closure structure in said first condition said cuff structure circumferentially continuous is secure at the wearer's wrist and the cuff can't slide upwardly along the wearer's forearm regardless of whether said ventilation slit is opened or closed;

a fastener structure for selectively opening and closing said ventilation slit, said fastening structure including an elongate slide fastener with a pair of elongate track members each secured respectively to a side of said ventilation slit, and a first slide closure member moving between a first position and a second position to respectively close and open said ventilation slit; and outwardly expose said air-permeable panel, wherein said first slide member in said first position thereof is spaced away from said cuff structure and adjacent said elbow portion of the respective sleeve and said elongate track portions are joined along their length extending from said first slide member toward said cuff structure to at least partially close said ventilation slit, and in said second position said first slide member is moved away from said elbow portion of the respective sleeve and toward said cuff structure to at least partially disconnect said elongate track portions in the extent of said closure member between said first slide member and said elbow portion from one another and to thereby at least partially open said ventilation slit and outwardly expose said air-permeable panel in the extent of said ventilation slit between said elbow portion and said first slide member;

wherein said slide fastener further includes a second slide member moving along said elongate track portions, said second slide member in a first position at said cuff structure joining said elongate track portions in the extent of said ventilation slit extending from said second slide member toward said elbow portion to at least partially close said slide fastener, and said second slide member being movable to a second position spaced from said cuff structure toward said elbow portion of said sleeve along said elongate track portions to at least partially disconnect said track portions from one another in the extent of said ventilation slit extending from said second slide member to said termination end of said cuff structure so as to expose said air-permeable panel.

* * * * *